United States Patent [19]

Pirwitz

[11] Patent Number: 4,860,047

[45] Date of Patent: Aug. 22, 1989

[54] FUSER SYSTEM UTILIZING A PRESSURE WEB

[75] Inventor: Robert G. Pirwitz, Fairport, N.Y.

[73] Assignee: Xerox Corporation, Stamford, Conn.

[21] Appl. No.: 188,890

[22] Filed: May 2, 1988

[51] Int. Cl.[4] ..... G03G 15/0; H05B 1/00

[52] U.S. Cl. ..... 355/290; 219/216

[58] Field of Search ..... 355/3 FU, 14 FU; 219/469, 216; 432/60

[56] References Cited

U.S. PATENT DOCUMENTS

| | | | |
|---|---|---|---|
| 3,718,116 | 2/1973 | Thettu | 118/266 |
| 3,951,538 | 4/1976 | Bar-on | 219/216 X |
| 4,112,280 | 9/1978 | Salsich et al. | 219/216 |
| 4,253,008 | 2/1981 | Dolan | 355/3 FU X |
| 4,689,471 | 8/1987 | Pirwitz et al. | 219/216 |
| 4,714,427 | 12/1987 | Tsuruoka et al. | 219/216 X |

FOREIGN PATENT DOCUMENTS

| | | | |
|---|---|---|---|
| 0137976 | 8/1984 | Japan | 355/3 FU |

*Primary Examiner*—A. T. Grimley
*Assistant Examiner*—Robert Beatty

[57] ABSTRACT

A low mass fuser roll fusing system incorporates a thin fabric-like web to maintain copy sheets in biased contact with a fuser roll during a fusing operation. The copy sheets are introduced to the fusing area at an entrance nip formed by a biasing assembly including a flat spring and a feed roller contacting the fuser roll.

1 Claim, 2 Drawing Sheets

FUSER SYSTEM UTILIZING A PRESSURE WEB

BACKGROUND OF THE INVENTION AND INFORMATION DISCLOSURE STATEMENT

This invention relates generally to an electrophotographic copying apparatus, and more particularly, to the heat and pressure fixing of toner images formed on a copy substrate by direct contact with a heated fusing member.

In the process of xerography, a light image of an original to be copied is typically recorded in the form of a latent electrostatic image upon a photosensitive member with subsequent development of the latent image by the application of marking particles commonly referred to as toner. The visual toner image is typically transferred from the member to a copy substrate, such as a sheet of plain paper, with subsequent affixing of the image by one of several fusing techniques. A preferred fusing system applies both heat and pressure to the copy substrate.

In one prior art fusing system, a fuser roll is used which has an outer surface or covering of polytetrafluoroethylene or silicone rubber, the former being known by the trade name Teflon, to which a release agent such as silicone oil is applied, the thickness of the Teflon being on the order of several mils and the thickness of the oil being less than 1 micron. Silicone based oils which possesses a relatively low surface energy, have been found to be materials that are suitable for use in a heated fuser roll environment where Teflon constitutes the outer surface of the fuser roll. In practice, a thin layer of silicone oil is applied to the surface of the heated roll to form an interface between the roll surface and the toner images carried on the support material. Thus a low surface energy layer is presented to the toner as it passes through the fuser nip and thereby prevents toner from offsetting to the fuser roll surface. A fuser roll construction of this type is disclosed in U.S. Pat. No. 3,718,116 assigned to Xerox Corporation.

While heat and pressure fusers of the type discussed above are desirable because of their thrmal efficiency, they possess some disadvantages because of their mechanical complexity, cost, long warm-up times and paper wrinkling. A second type of system is known in the prior art which reduces or eliminates these undesirable characteristics. This system utilizes a relatively low mass fuser roll member of the type disclosed, for example, in U.S. Pat. No. 4,689,471 assigned to Xerox Corporation. As disclosed in this patent, a low mass heated fuser roll cooperates with an elongated web member comprising a woven fabric to form an extended fusing area. One end of the pressure web is fixed while the other end is biased into pressure engagement with the fuser roll to form an entrance nip. The pressure web is an enabling feature of this type of system but its effectiveness depends upon several factors such as the type of copy substrate media being used and relative humidity conditions. As an example, certain types of copy media are as subject to stalling or jamming on the leading edge entrance of the fuser entrance nip. The pressure and location of the biasing means is therefore of critical importance.

The present invention is, therefore directed to a heat and pressure apparatus for fixing toner images to copy substrates, said apparatus comprising:

a fuser roll;

means for elevating the temperature of said fuser roll;

a pressure applying member in the form of a thin web having an elongated surface contacting said fuser roll to form a nip therebetween through which copy substrates pass with the toner images carried thereby contacting said fuser roll, one end of said thin web being anchored in a frame member and an area of said web adjacent the other end thereof being frictionally biased into engagement with said fuser roll; and a biasing assembly to bias an area of the thin web into contact with said fuser roll to form a nip entrance for receiving the lead edge of said copy substrates, said biasing assembly comprising a flat spring member and a feed roller positioned between said flat spring member and said fuser roll, said feed roller rotating in a direction opposite said fuser roll to form the entrance nip for said paper feed.

Further prior art believed to be material is U.S. Pat. No. 4,112,280 assigned to Eastman Kodak Company. The patent discloses an apparatus for heat processing a sheet of web material which includes a rotary drum and a guide web of low friction material and an idler web which cooperates with the moving drum to effect feed of the material through the processing path.

DETAILED DESCRIPTION OF THE INVENTION

Figure 1:
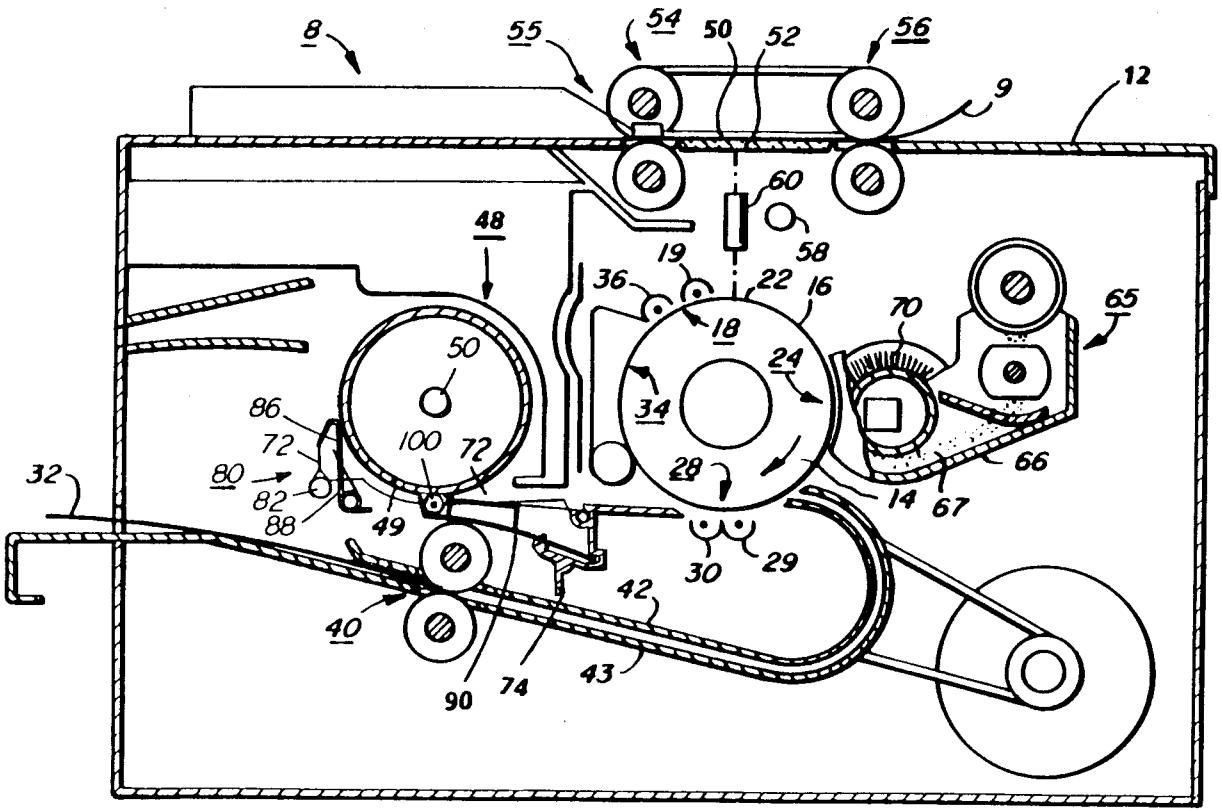
FIG. 1 is a side view in section of a reproduction machine having the improved heat and pressure fuser of the present invention.

Referring to FIG. 1 of the drawings, there is shown a xerographic-type reproduction machine 8 incorporating the present invention. Machine 8 has a suitable frame 12 on which the machine xerographic components are operatively supported. Briefly, as will be familiar to those skilled in the xerographic printing and copying arts, the xerographic components of the machine include a charge retentive recording member, shown here in the form of a rotatable photoreceptor 14. In the exemplary arrangement shown, photoreceptor 14 comprises a drum having a photoconductive surface 16. Other photoreceptor types such as belt, web, etc. may instead be employed. Operatively disposed about the periphery of photoreceptor 14 are a charging station 18 with charge corotron 19 for place a uniform charge on the photoconductive surface 16 of photoreceptor 14, exposure station 22 where the previously charged photoconductive surface 16 is exposed to image rays of a document 9 being copied or reproduced to thereby form a latent electrostatic image on the charge retentive surface; development station 24 where the latent electrostatic image created on photoconductive surface 16 is developed by toner; combination transfer and detack station 28 with transfer corotron 29 detack corotron 30 for sequentially transferring the developed image to a suitable copy substrate material such as a copy sheet 32 brought forward in timed relation with the developed image on photoconductive surface 16 and lessening the forces of attraction between the copy substrate and the charge retentive member; cleaning station 34 and discharge corotron 36 for removing leftover developer from photoconductive surface 16 and neutralizing residual charges thereon.

A copy sheet 32 is brought forward to transfer station 28 by feed roll pair 40. Sheet guides 42, 43, serve to guide the sheet through an approximately 180 degree turn prior to the copy substrate reaching the transfer station 28. Following transfer, the sheet 28 is carried forward to a fusing station 48 where the toner image is contacted by fusing roll 49, forming one member of a heat and pressure fuser. Fusing roll 49 is heated by a suitable heater such as quartz lamp 50 disposed within the interior of roll 49. After fusing, the copy sheet 32 is discharged from the machine.

A transparent platen 50 supports the document 9 as the document is moved past a scan area 52 by a constant velocity type transport 54. As will be understood, scan area 52 is in effect a scan line extending across the width of platen 50 at a desired point along platen 50 where the document is scanned line by line as the document is moved along platen 50 by transport 54. Transport 54 has input and output document feed roll pairs 55, 56 respectively on each side of scan area 52 for moving document 9 across platen 50 at a predetermined speed. Exposure lamp 58 is provided to illuminate a strip-like area of platen 50 at scan area 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer 67. As will be understood by those skilled in the art, developer 67 comprises a mixture of larger carrier particles and smaller toner or ink particles. A rotatable magnetic brush developer roll 70 is disposed in a predetermined operative relation to the photoconductive surface 16 in developer housing 65, roll 70 serving to bring developer from sump 66 into developing relation with photoreceptor 14 to develop the latent electrostatic images formed on the photoconductive surface 16.

The fuser roll 49 comprises a thin-walled thermally conductive tube having a thin (i.e. approximately 0.005 inch (0.01 Centimeters)) coating of silicon rubber on the exterior surface thereof which contacts the toner images on the copy substrate to thereby affix them to the substrate. A release agent management sytem, not shown, applies a thin layer of silicone oil to the surface of the fuser roll for the prevention of toner offset thereto as well as reducing the torque required to effect rotation of the fuser roll. In one operative embodiment of the fuser roll its diameter was 3.3 inches and had a length of 40 inches. This embodiment is typically used to fuse images on copy substrates that are 3 feet (0.91 Meters) wide by 4 feet (1.22 Meters) in length.

The fuser apparatus 48 in the preferred embodiment also comprises a non-rotating, elongated pressure web member 72. As viewed in FIGS. 1 and 2, one end of web 72 is anchored in a frame structure 74. The opposite end of the web is biased into engagement with the fuser roll so that the fuser roll and the web cooperate to form an enlongated nip 78 therebetween. Web 72 can be a thin fabric.

A pressure applying mechanism 80 creates a force between the roll and web so as to produce a frictional force therebetween that keeps the web in tension so it can provide suitable pressure to the surface of the fuser roll. Mechanism 80 encompasses a weighted rod 82 disposed in a loop 84 formed in web 72. A portion of the web intermediate to the two ends thereof rides over a curved portion 86 of web frame or support member 88. A biasing force is applied to the frame or support member 88 by leaf spring 89 to thereby urge the web 72 into engagement with the fuser roll 49. The force so applied is just sufficient to keep the web against the roll.

A flat spring assembly 90 has one end anchored in frame structure 74 and functions as a leaf spring forcing the web 72 and feed roller 100 against the fuser roll 49. Assmebly 90 comprises a first, rectangular-shaped leaf spring 91 and a second profiled leaf spring 92 shown in the bottom view of FIG. 3. (FIG. 3 represents view 3—3 of FIG. 2, reduced and rotated clockwise for better perspective. Thus, FIG. 3 shows the entire 0.91 meter width of the fuser entrance nip area from a bottom perspective.) Spring 91 supports and loads roller 100 along its entire length, thus providing uniform nip pressure across the entire nip area. Spring 92 enables this uniform nip pressure to be beneficially changed by increasing the pressure along critical areas of the nip. In the profile shown in FIG. 3, spring 92 provides increased bias (pressure) in the center with decreasing bias towards the outboard ends. Other pressure profiles are possible by reshaping the physical profiles of the spring 92.

Figure 2:
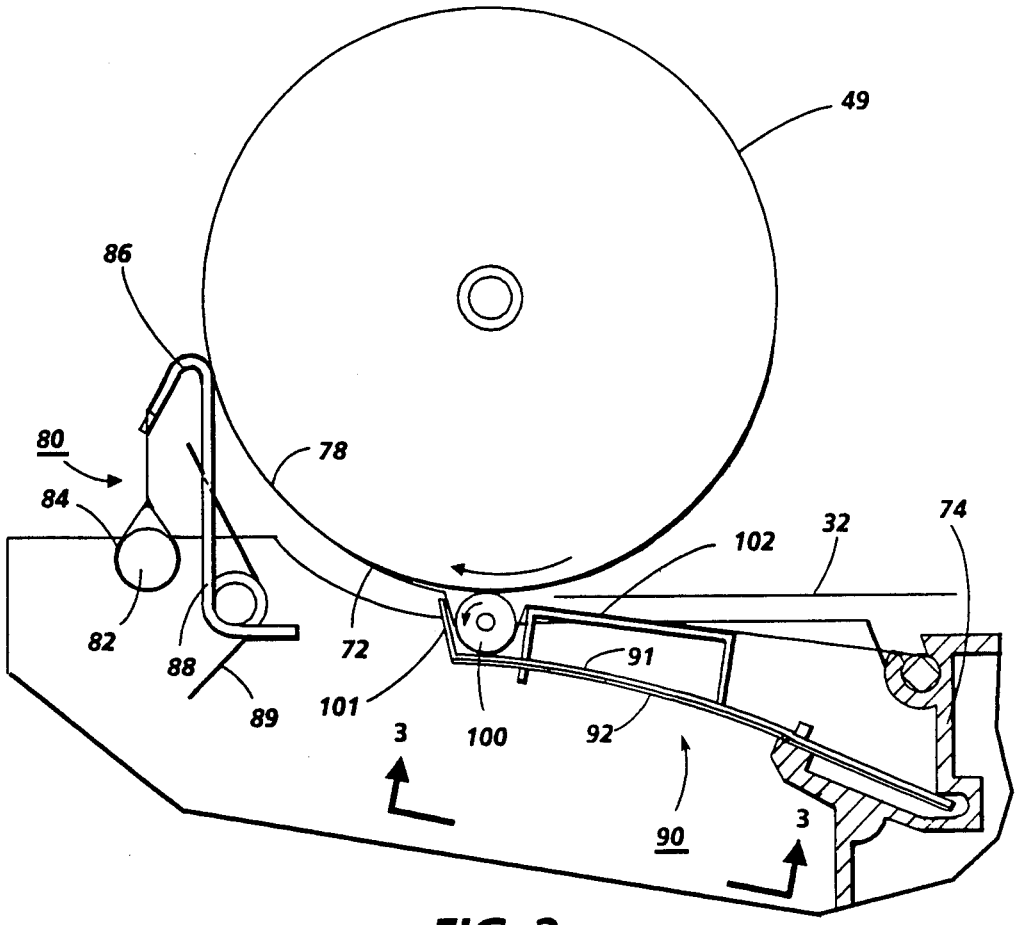
FIG. 2 is an enlarged view of the heat and pressure fuser shown in FIG. 1, showing the web-biasing assembly of the present invention.
Figure 3:
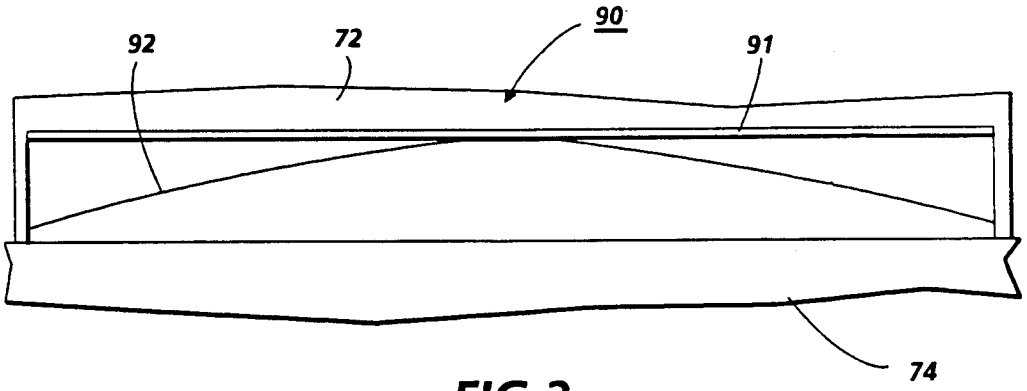
FIG. 3 is a sectional view of the bottom of the web-biasing assembly shown in FIG. 2, rotated clockwise and reduced.

As shown in FIG. 2, an upward segment 101 of spring 91, in cooperation with backup plate 102, serves to define the sides of the cavity in which roller 100 operates. Backup plate 102 also efficiently guides the incoming copy sheet 32 to the top of roller 100.

Roller 100 is mounted so as to be free to rotate and is driven in the indicated direction by the motion of fuser 49. (Roller 100 may be independently driven, if desired). Roller 100 can be made of a solid rod material, a hollow tubing or a flexible shaft. Preferably the roller is coated with a fluorocarbon material to prevent buildup of any contaminants. Web 72 provides a bearing surface for the roller. The copy substrate, as it enters the nip area formed between fuser roller 49 and feed roller 100, has less of a tendency to stall since its leading edge is presented between two moving members. Paper cockle caused by the rapid drying of high moisture content copy substrate, is also greatly reduced.

What is claimed is:

1. A heat and pressure apparatus for fixing toner images to copy substrates, said apparatus comprising:

a fuser roll;

a pressure applying member in the form of a thin web having an elongated surface contacting said fuser roll to form a nip therebetween through which copy substrates pass with the toner images carried thereon contacting said fuser roll, one end of said thin web being anchored in a frame member and an area of said web adjacent the other end thereof being frictionally biased into engagement with said fuser roll; and a biasing assembly to bias an area of the thin web into contact with said fuser roll to form a nip entrance for receiving the lead edge of said copy substrates, said biasing assembly comprising a first rectangular flat spring, and a second profiled leaf spring mounted beneath said rectangular flat spring, and a feed roller positioned between said biasing assembly and said fuser roll, said feed roller rotating in a direction opposite said fuser roll to form the entrance nip and said profiled leaf spring providing a varied pressure along the entrance nip consistent with its profile.

* * * * *